US011580789B2

(12) United States Patent
Zhu

(10) Patent No.: US 11,580,789 B2
(45) Date of Patent: Feb. 14, 2023

(54) SYSTEM LOAD BASED SAFETY OPERATOR WARNING SYSTEM

(71) Applicant: Baidu USA LLC, Sunnyvale, CA (US)

(72) Inventor: Fan Zhu, Sunnyvale, CA (US)

(73) Assignee: BAIDU USA LLC, Sunnyvale, CA (US)

( * ) Notice: Subject to any disclaimer, the term of this patent is extended or adjusted under 35 U.S.C. 154(b) by 279 days.

(21) Appl. No.: 16/849,272

(22) Filed: Apr. 15, 2020

(65) Prior Publication Data

US 2021/0327162 A1 Oct. 21, 2021

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01); *G07C 5/0841* (2013.01)

(58) Field of Classification Search
CPC .... G07C 5/008; G07C 5/0808; G07C 5/0841; B60W 10/06; B60W 10/18; B60W 10/20; B60W 50/00; B60W 50/14
See application file for complete search history.

(56) References Cited

U.S. PATENT DOCUMENTS

2019/0001964 A1* 1/2019 Lin ..... B60W 50/04

* cited by examiner

*Primary Examiner* — Sizo B Vilakazi
(74) *Attorney, Agent, or Firm* — Womble Bond Dickinson (US) LLP

(57) ABSTRACT

According to one embodiment, a method of generating warning messages based on system load of an autonomous driving vehicle can relieve a safety operator of the burden of constantly monitoring the vehicle and outside driving environments. The method uses a threshold for each of a number of system load parameters to determine whether the vehicle has a heavy system load that needs the attention of the safety operator. In one example, the vehicle can use a CPU usage threshold and an end-to-end latency threshold to determine whether the vehicle has a heavy system load while travelling on a road segment. If any of the thresholds is exceeded, the vehicle can send a warning message to the safety driver. The system load thresholds may be determined from data collected from the autonomous driving vehicle when it previously travelled on the road segment.

20 Claims, 8 Drawing Sheets

SYSTEM LOAD BASED SAFETY OPERATOR WARNING SYSTEM

TECHNICAL FIELD

Embodiments of the present disclosure relate generally to operating autonomous vehicles. More particularly, embodiments of the disclosure relate to generating safety warning messages based on system load.

BACKGROUND

Vehicles operating in an autonomous mode (e.g., driverless) can relieve occupants, especially the driver, from some driving-related responsibilities. When operating in an autonomous mode, the vehicle can navigate to various locations using onboard sensors, allowing the vehicle to travel with minimal human interaction or in some cases without any passengers.

An autonomous driving vehicle (ADV) includes an autonomous driving system (ADS) with software applications and/or hardware components for performing driving-related functions. Typically, the more complex a driving environment is, the more intensive computations the ADS needs to perform to operate the ADV. Given a set of hardware capabilities, more intensive computations would increase the load of the ADS. When the ADS is under heavy load, the performance of the system tends to decrease, which may prevent the system from handling some extremely complicated driving environments.

On the other hand, as the last resort for safety, a human driver typically sits in the ADV to watch for any danger and to take over the control of the ADV if based on his judgement the driving-by-wire system cannot handle the danger. However, the above scenario requires the human driver to be attentive to the outside environment and the ADV itself all the time, which is a demanding requirement, particularly when the journey is long.

BRIEF DESCRIPTION OF THE DRAWINGS

Embodiments of the disclosure are illustrated by way of example and not limitation in the figures of the accompanying drawings in which like references indicate similar elements.

DETAILED DESCRIPTION

Figure 1:
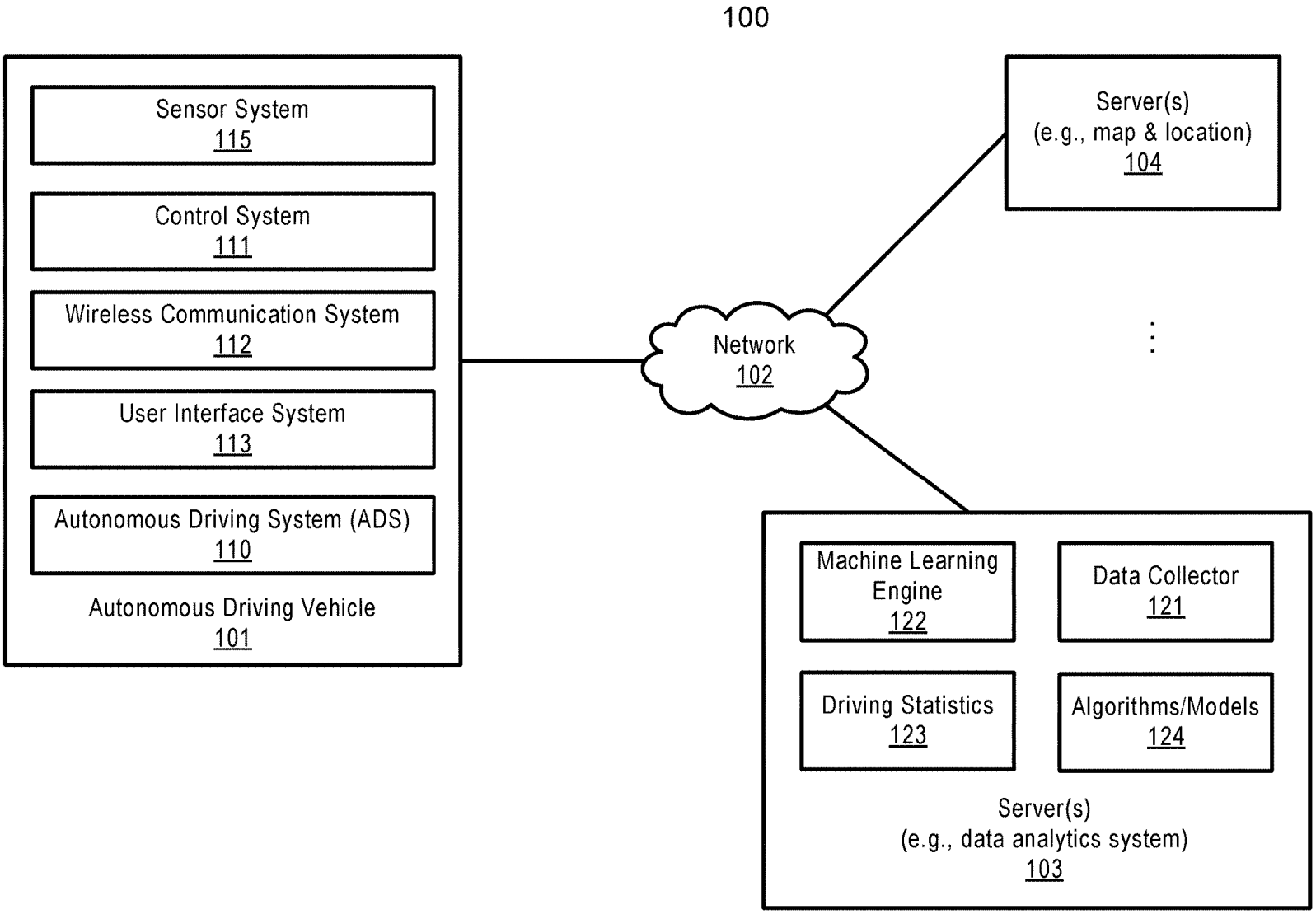
FIG. 1 is a block diagram illustrating a networked system according to one embodiment.

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures.

Reference in the specification to "one embodiment" or "an embodiment" means that a particular feature, structure, or characteristic described in conjunction with the embodiment can be included in at least one embodiment of the disclosure. The appearances of the phrase "in one embodiment" in various places in the specification do not necessarily all refer to the same embodiment.

According to some embodiments, described herein are system and methods for generating warning messages for safety operators in an ADV based on the system load of the ADV. According to one embodiment, an exemplary method includes the operations of monitoring a number of system load parameters of the ADV that is travelling in an autonomous mode on a particular road segment; and determining if a value for any one of the plurality of system load parameters exceeds a threshold that is predetermined based on previous system loads of the ADV when travelling on the particular road segment. The method further includes the operation of generating a warning message in response to determining that the value for at least one of the plurality of system load parameters exceeds the corresponding threshold; and sending the warning message to a safety operator.

In one embodiment, the warning message can be sent to a display screen for the safety operator to read, or can be translated into a horn alarm for the safety operator to hear. The safety operator, upon receiving the warning message, can take over the control of the ADV, and manually drive the ADV.

In one embodiment, the warning message may be generated when the ADV encounters a complex driving scenario (also referred to as a driving environment) on the road segment that the ADV is not designed, programmed, or trained to handle. The ADV can monitor a number of system load parameters to identify such complex driving scenarios so that a safety operator can take over the control of the ADV.

In one embodiment, the system load may be directly related to the complexity of a driving scenario. The complexity of a driving scenario may be measured by a number of system load parameters. Examples of the system load parameters include the average of usages of multiple central processing units (CPU) in the ADV, and an end-to-end (E2E) latency, which can be a time taken by the ADV from receiving sense data to taking an appropriate action in response to the sensor data.

In one embodiment, the threshold for each system load parameter can be derived from a distribution of values for the system load parameter when the ADV travels on the particular road segment for one or more trips. The ADV can travel on the road segment to collect data to generate thresholds for system load parameters. The ADV can collect data points for the average CPU usage of the ADV and the E2E latency related to various driving scenarios. The data points for each system load parameter can be plotted into a particular distribution, for example, a normal distribution. The threshold for each system load can be the value corresponding to a particular percentile (e.g., 99 percentile) on the distribution for the system load parameter.

Autonomous Driving Vehicle

FIG. 1 is a block diagram illustrating an autonomous vehicle network configuration according to one embodiment of the disclosure. Referring to FIG. 1, network configuration 100 includes autonomous vehicle 101 that may be communicatively coupled to one or more servers 103-104 over a network 102. Although there is one autonomous vehicle shown, multiple autonomous vehicles can be coupled to each other and/or coupled to servers 103-104 over network 102. Network 102 may be any type of networks such as a local area network (LAN), a wide area network (WAN) such as the Internet, a cellular network, a satellite network, or a combination thereof, wired or wireless. Server(s) 103-104 may be any kind of servers or a cluster of servers, such as Web or cloud servers, application servers, backend servers, or a combination thereof. Servers 103-104 may be data analytics servers, content servers, traffic information servers, map and point of interest (MPOI) servers, or location servers, etc.

An autonomous vehicle refers to a vehicle that can be configured to in an autonomous mode in which the vehicle navigates through an environment with little or no input from a driver. Such an autonomous vehicle can include a sensor system having one or more sensors that are configured to detect information about the environment in which the vehicle operates. The vehicle and its associated controller(s) use the detected information to navigate through the environment. Autonomous vehicle 101 can operate in a manual mode, a full autonomous mode, or a partial autonomous mode.

In one embodiment, autonomous vehicle 101 includes, but is not limited to, autonomous driving system (ADS) 110, vehicle control system 111, wireless communication system 112, user interface system 113, and sensor system 115. Autonomous vehicle 101 may further include certain common components included in ordinary vehicles, such as, an engine, wheels, steering wheel, transmission, etc., which may be controlled by vehicle control system 111 and/or ADS 110 using a variety of communication signals and/or commands, such as, for example, acceleration signals or commands, deceleration signals or commands, steering signals or commands, braking signals or commands, etc.

Components 110-115 may be communicatively coupled to each other via an interconnect, a bus, a network, or a combination thereof. For example, components 110-115 may be communicatively coupled to each other via a controller area network (CAN) bus. A CAN bus is a vehicle bus standard designed to allow microcontrollers and devices to communicate with each other in applications without a host computer. It is a message-based protocol, designed originally for multiplex electrical wiring within automobiles, but is also used in many other contexts.

Figure 2:
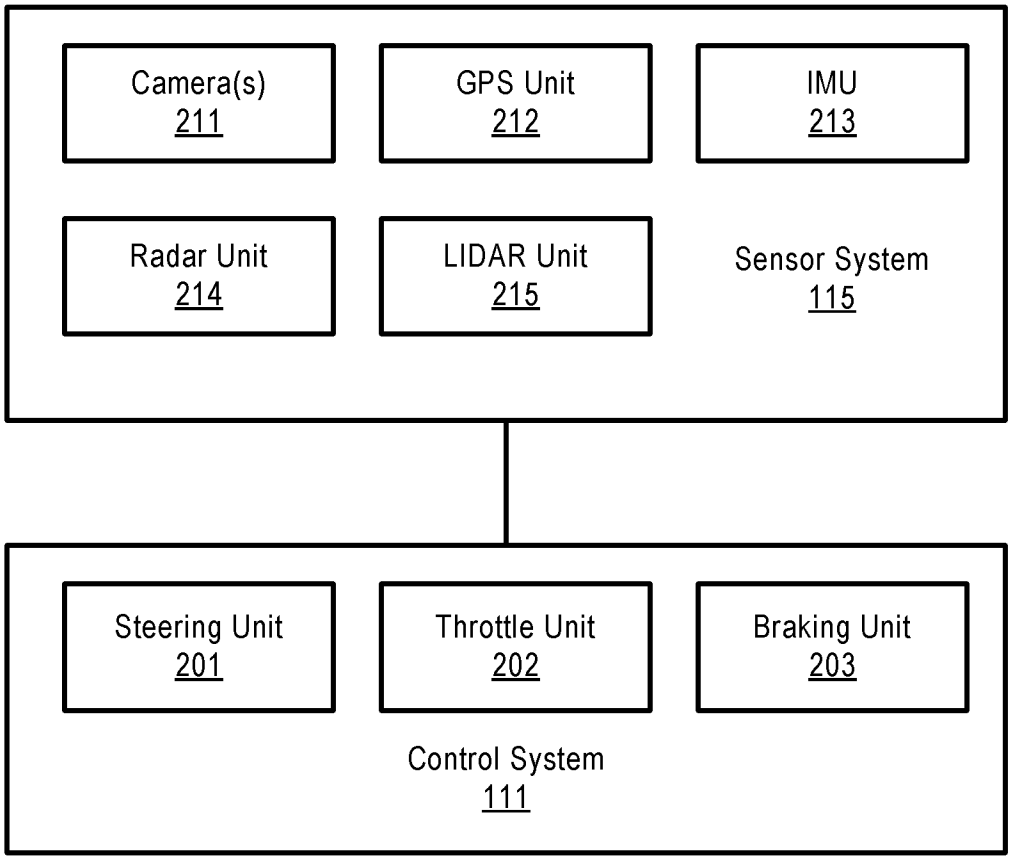
FIG. 2 is a block diagram illustrating an example of an autonomous vehicle according to one embodiment.

Referring now to FIG. 2, in one embodiment, sensor system 115 includes, but it is not limited to, one or more cameras 211, global positioning system (GPS) unit 212, inertial measurement unit (IMU) 213, radar unit 214, and a light detection and range (LIDAR) unit 215. GPS system 212 may include a transceiver operable to provide information regarding the position of the autonomous vehicle. IMU unit 213 may sense position and orientation changes of the autonomous vehicle based on inertial acceleration. Radar unit 214 may represent a system that utilizes radio signals to sense objects within the local environment of the autonomous vehicle. In some embodiments, in addition to sensing objects, radar unit 214 may additionally sense the speed and/or heading of the objects. LIDAR unit 215 may sense objects in the environment in which the autonomous vehicle is located using lasers. LIDAR unit 215 could include one or more laser sources, a laser scanner, and one or more detectors, among other system components. Cameras 211 may include one or more devices to capture images of the environment surrounding the autonomous vehicle. Cameras 211 may be still cameras and/or video cameras. A camera may be mechanically movable, for example, by mounting the camera on a rotating and/or tilting a platform.

Sensor system 115 may further include other sensors, such as, a sonar sensor, an infrared sensor, a steering sensor, a throttle sensor, a braking sensor, and an audio sensor (e.g., microphone). An audio sensor may be configured to capture sound from the environment surrounding the autonomous vehicle. A steering sensor may be configured to sense the steering angle of a steering wheel, wheels of the vehicle, or a combination thereof. A throttle sensor and a braking sensor sense the throttle position and braking position of the vehicle, respectively. In some situations, a throttle sensor and a braking sensor may be integrated as an integrated throttle/braking sensor.

In one embodiment, vehicle control system 111 includes, but is not limited to, steering unit 201, throttle unit 202 (also referred to as an acceleration unit), and braking unit 203. Steering unit 201 is to adjust the direction or heading of the vehicle. Throttle unit 202 is to control the speed of the motor or engine that in turn controls the speed and acceleration of the vehicle. Braking unit 203 is to decelerate the vehicle by providing friction to slow the wheels or tires of the vehicle. Note that the components as shown in FIG. 2 may be implemented in hardware, software, or a combination thereof.

Referring back to FIG. 1, wireless communication system 112 is to allow communication between autonomous vehicle 101 and external systems, such as devices, sensors, other vehicles, etc. For example, wireless communication system 112 can wirelessly communicate with one or more devices directly or via a communication network, such as servers 103-104 over network 102. Wireless communication system 112 can use any cellular communication network or a wireless local area network (WLAN), e.g., using WiFi to communicate with another component or system. Wireless communication system 112 could communicate directly with a device (e.g., a mobile device of a passenger, a display device, a speaker within vehicle 101), for example, using an infrared link, Bluetooth, etc. User interface system 113 may be part of peripheral devices implemented within vehicle 101 including, for example, a keyboard, a touch screen display device, a microphone, and a speaker, etc.

Some or all of the functions of autonomous vehicle 101 may be controlled or managed by ADS 110, especially when operating in an autonomous driving mode. ADS 110 includes the necessary hardware (e.g., processor(s), memory, storage) and software (e.g., operating system, planning and routing programs) to receive information from sensor system 115, control system 111, wireless communication system 112, and/or user interface system 113, process the received information, plan a route or path from a starting point to a destination point, and then drive vehicle 101 based on the planning and control information. Alternatively, ADS 110 may be integrated with vehicle control system 111.

For example, a user as a passenger may specify a starting location and a destination of a trip, for example, via a user interface. ADS 110 obtains the trip related data. For example, ADS 110 may obtain location and route information from an MPOI server, which may be a part of servers 103-104. The location server provides location services and the MPOI server provides map services and the POIs of certain locations. Alternatively, such location and MPOI information may be cached locally in a persistent storage device of ADS 110.

While autonomous vehicle 101 is moving along the route, ADS 110 may also obtain real-time traffic information from a traffic information system or server (TIS). Note that servers 103-104 may be operated by a third party entity. Alternatively, the functionalities of servers 103-104 may be integrated with ADS 110. Based on the real-time traffic information, MPOI information, and location information, as well as real-time local environment data detected or sensed by sensor system 115 (e.g., obstacles, objects, nearby vehicles), ADS 110 can plan an optimal route and drive vehicle 101, for example, via control system 111, according to the planned route to reach the specified destination safely and efficiently.

Server 103 may be a data analytics system to perform data analytics services for a variety of clients. In one embodiment, data analytics system 103 includes data collector 121 and machine learning engine 122. Data collector 121 collects driving statistics 123 from a variety of vehicles, either autonomous vehicles or regular vehicles driven by human drivers. Driving statistics 123 include information indicating the driving commands (e.g., throttle, brake, steering commands) issued and responses of the vehicles (e.g., speeds, accelerations, decelerations, directions) captured by sensors of the vehicles at different points in time. Driving statistics 123 may further include information describing the driving environments at different points in time, such as, for example, routes (including starting and destination locations), MPOIs, road conditions, weather conditions, etc.

Based on driving statistics 123, machine learning engine 122 generates or trains a set of rules, algorithms, and/or predictive models 124 for a variety of purposes. Algorithms 124 can then be uploaded on ADVs to be utilized during autonomous driving in real-time.

Figure 3A:
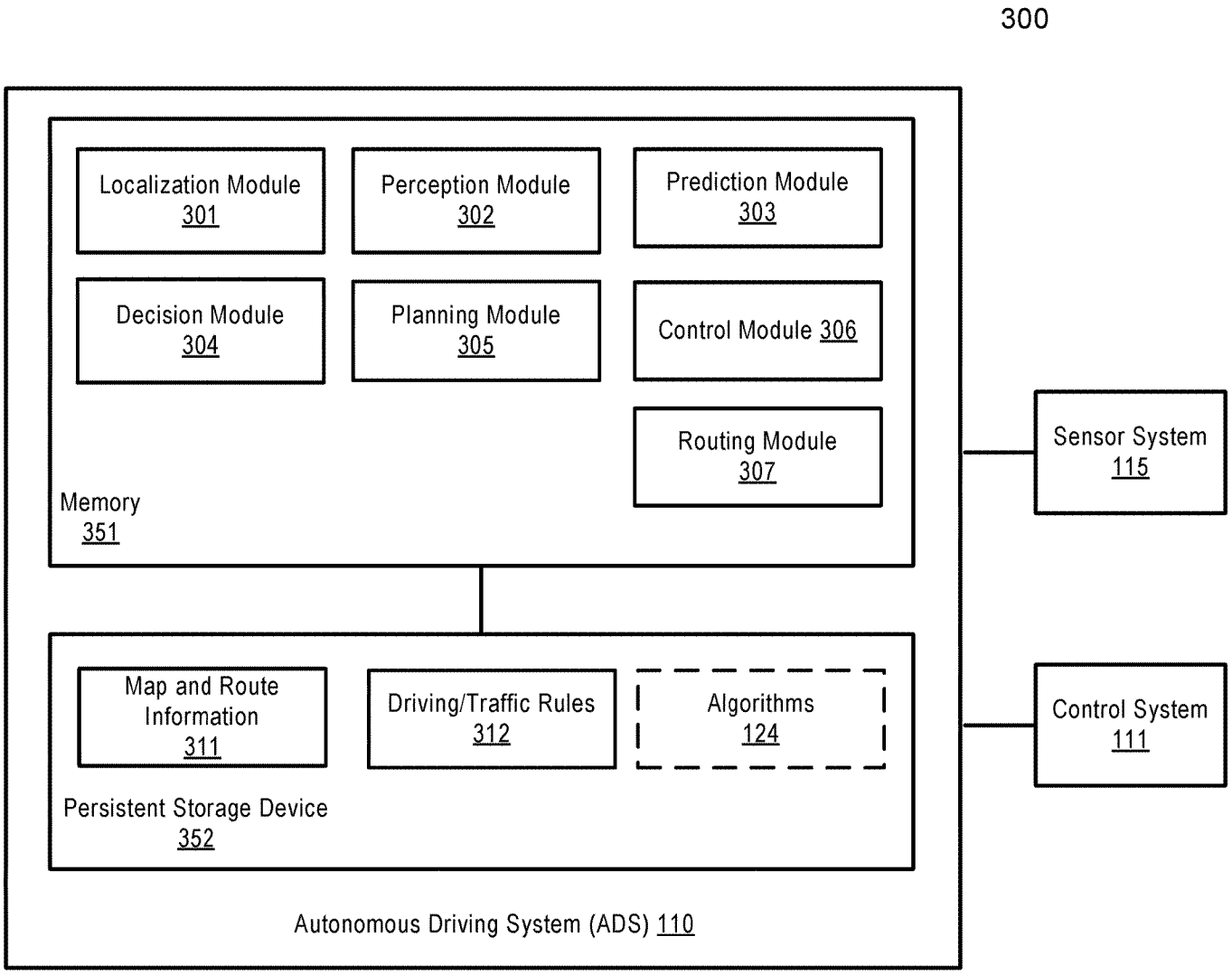
FIGS. 3A-3B are block diagrams illustrating an example of a primary autonomous driving system used with an autonomous vehicle according to one embodiment.
Figure 3B:
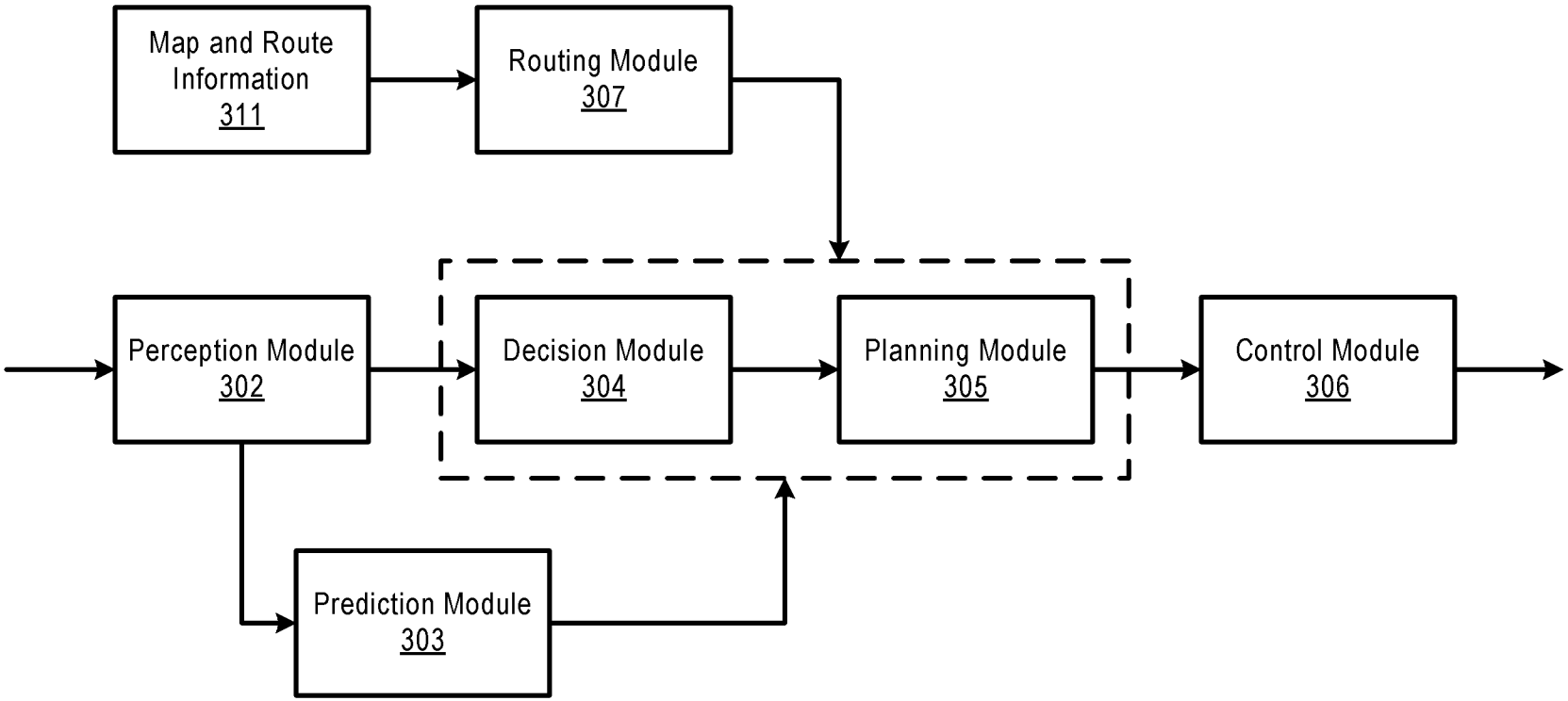

FIGS. 3A and 3B are block diagrams illustrating an example of a primary autonomous driving system used with an autonomous vehicle according to one embodiment. System 300 may be implemented as a part of autonomous vehicle 101 of FIG. 1 including, but is not limited to, ADS 110, control system 111, and sensor system 115. Referring to FIGS. 3A-3B, ADS 110 includes, but is not limited to, localization module 301, perception module 302, prediction module 303, decision module 304, planning module 305, control module 306, and routing module 307.

Some or all of modules 301-307 may be implemented in software, hardware, or a combination thereof. For example, these modules may be installed in persistent storage device 352, loaded into memory 351, and executed by one or more processors (not shown). Note that some or all of these modules may be communicatively coupled to or integrated with some or all modules of vehicle control system 111 of FIG. 2. Some of modules 301-307 may be integrated together as an integrated module.

Localization module 301 determines a current location of autonomous vehicle 300 (e.g., leveraging GPS unit 212) and manages any data related to a trip or route of a user. Localization module 301 (also referred to as a map and route module) manages any data related to a trip or route of a user. A user may log in and specify a starting location and a destination of a trip, for example, via a user interface. Localization module 301 communicates with other components of autonomous vehicle 300, such as map and route information 311, to obtain the trip related data. For example, localization module 301 may obtain location and route information from a location server and a map and POI (MPOI) server. A location server provides location services and an MPOI server provides map services and the POIs of certain locations, which may be cached as part of map and route information 311. While autonomous vehicle 300 is moving along the route, localization module 301 may also obtain real-time traffic information from a traffic information system or server.

Based on the sensor data provided by sensor system 115 and localization information obtained by localization module 301, a perception of the surrounding environment is determined by perception module 302. The perception information may represent what an ordinary driver would perceive surrounding a vehicle in which the driver is driving. The perception can include the lane configuration, traffic light signals, a relative position of another vehicle, a pedestrian, a building, crosswalk, or other traffic related signs (e.g., stop signs, yield signs), etc., for example, in a form of an object. The lane configuration includes information describing a lane or lanes, such as, for example, a shape of the lane (e.g., straight or curvature), a width of the lane, how many lanes in a road, one-way or two-way lane, merging or splitting lanes, exiting lane, etc.

Perception module 302 may include a computer vision system or functionalities of a computer vision system to process and analyze images captured by one or more cameras in order to identify objects and/or features in the environment of autonomous vehicle. The objects can include traffic signals, road way boundaries, other vehicles, pedestrians, and/or obstacles, etc. The computer vision system may use an object recognition algorithm, video tracking, and other computer vision techniques. In some embodiments, the computer vision system can map an environment, track objects, and estimate the speed of objects, etc. Perception module 302 can also detect objects based on other sensors data provided by other sensors such as a radar and/or LIDAR.

For each of the objects, prediction module 303 predicts what the object will behave under the circumstances. The prediction is performed based on the perception data perceiving the driving environment at the point in time in view of a set of map/rout information 311 and traffic rules 312. For example, if the object is a vehicle at an opposing direction and the current driving environment includes an intersection, prediction module 303 will predict whether the vehicle will likely move straight forward or make a turn. If the perception data indicates that the intersection has no traffic light, prediction module 303 may predict that the vehicle may have to fully stop prior to enter the intersection. If the perception data indicates that the vehicle is currently at a left-turn only lane or a right-turn only lane, prediction module 303 may predict that the vehicle will more likely make a left turn or right turn respectively.

For each of the objects, decision module 304 makes a decision regarding how to handle the object. For example, for a particular object (e.g., another vehicle in a crossing route) as well as its metadata describing the object (e.g., a speed, direction, turning angle), decision module 304 decides how to encounter the object (e.g., overtake, yield, stop, pass). Decision module 304 may make such decisions according to a set of rules such as traffic rules or driving rules 312, which may be stored in persistent storage device 352.

Routing module 307 is configured to provide one or more routes or paths from a starting point to a destination point. For a given trip from a start location to a destination location, for example, received from a user, routing module 307 obtains route and map information 311 and determines all possible routes or paths from the starting location to reach the destination location. Routing module 307 may generate a reference line in a form of a topographic map for each of the routes it determines from the starting location to reach the destination location. A reference line refers to an ideal route or path without any interference from others such as other vehicles, obstacles, or traffic condition. That is, if there is no other vehicle, pedestrians, or obstacles on the road, an ADV should exactly or closely follows the reference line. The topographic maps are then provided to decision module 304 and/or planning module 305. Decision module 304 and/or planning module 305 examine all of the possible routes to select and modify one of the most optimal routes in view of other data provided by other modules such as traffic conditions from localization module 301, driving environment perceived by perception module 302, and traffic condition predicted by prediction module 303. The actual path or route for controlling the ADV may be close to or different from the reference line provided by routing module 307 dependent upon the specific driving environment at the point in time.

Based on a decision for each of the objects perceived, planning module 305 plans a path or route for the autonomous vehicle, as well as driving parameters (e.g., distance, speed, and/or turning angle), using a reference line provided by routing module 307 as a basis. That is, for a given object, decision module 304 decides what to do with the object, while planning module 305 determines how to do it. For example, for a given object, decision module 304 may decide to pass the object, while planning module 305 may determine whether to pass on the left side or right side of the object. Planning and control data is generated by planning module 305 including information describing how vehicle 300 would move in a next moving cycle (e.g., next route/path segment). For example, the planning and control data may instruct vehicle 300 to move 10 meters at a speed of 30 mile per hour (mph), then change to a right lane at the speed of 25 mph.

Based on the planning and control data, control module 306 controls and drives the autonomous vehicle, by sending proper commands or signals to vehicle control system 111, according to a route or path defined by the planning and control data. The planning and control data include sufficient information to drive the vehicle from a first point to a second point of a route or path using appropriate vehicle settings or driving parameters (e.g., throttle, braking, steering commands) at different points in time along the path or route.

In one embodiment, the planning phase is performed in a number of planning cycles, also referred to as driving cycles, such as, for example, in every time interval of 100 milliseconds (ms). For each of the planning cycles or driving cycles, one or more control commands will be issued based on the planning and control data. That is, for every 100 ms, planning module 305 plans a next route segment or path segment, for example, including a target position and the time required for the ADV to reach the target position. Alternatively, planning module 305 may further specify the specific speed, direction, and/or steering angle, etc. In one embodiment, planning module 305 plans a route segment or path segment for the next predetermined period of time such as 5 seconds. For each planning cycle, planning module 305 plans a target position for the current cycle (e.g., next 5 seconds) based on a target position planned in a previous cycle. Control module 306 then generates one or more control commands (e.g., throttle, brake, steering control commands) based on the planning and control data of the current cycle.

Note that decision module 304 and planning module 305 may be integrated as an integrated module. Decision module 304/planning module 305 may include a navigation system or functionalities of a navigation system to determine a driving path for the autonomous vehicle. For example, the navigation system may determine a series of speeds and directional headings to affect movement of the autonomous vehicle along a path that substantially avoids perceived obstacles while generally advancing the autonomous vehicle along a roadway-based path leading to an ultimate destination. The destination may be set according to user inputs via user interface system 113. The navigation system may update the driving path dynamically while the autonomous vehicle is in operation. The navigation system can incorporate data from a GPS system and one or more maps so as to determine the driving path for the autonomous vehicle.

According to one embodiment, system 300 as shown in FIG. 3A is referred to as an ADS. An ADV may include a primary ADS and a redundant (or backup, secondary) ADS. The primary ADS is configured to drive the vehicle in normal operations, while the redundant ADS operates in a standby mode and configured to monitor the operations or operating status of the primary ADS. In response to determining that the primary ADS fails to function properly, the redundant ADS may take over the control of the vehicle, for example, transition the vehicle to a safer condition. Each of the primary ADS and the redundant ADS may include some or all of the components as shown in FIG. 3A. In one embodiment, the redundant ADS may have fewer functionalities as of the primary ADS. For example, in response to a failure signal received from the primary ADS, the redundant ADS may simply decelerate and/or stop the vehicle.

System Load Based Warning

Figure 4:
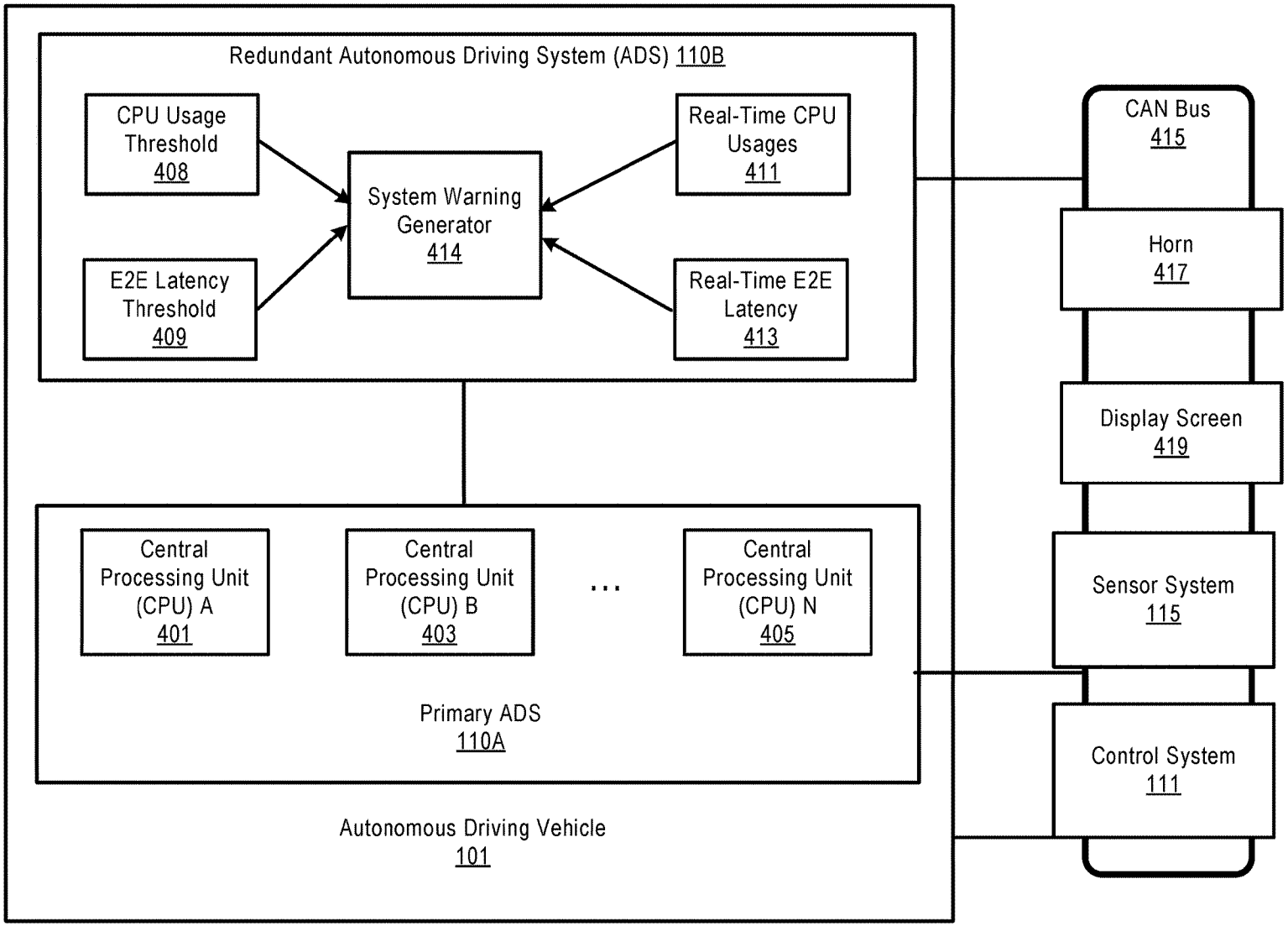
FIG. 4 is a block diagram illustrating an example of a system for generating warning messages based on system load according to one embodiment.

FIG. 4 is a block diagram illustrating an example of a system for generating warning messages based on system load according to one embodiment. Referring to FIG. 4, in this example, ADV 101 includes a primary ADS 110A and a redundant ADS 110B. As described above, primary ADS 110A and redundant ADS 110B may have the same or similar functionalities. During the normal operations, primary ADS 110A is responsible for driving the vehicle, while redundant ADS 110B operates in a standby mode. When primary ADS 110A fails to operate, redundant ADS 110B takes over the control of the vehicle.

As an example, ADV 101 is travelling on a particular road segment, for which a threshold for each of a number of system load parameters has been established based on system load data from previous trips on the road segment. The thresholds may be set up based on the driving data captured and collected from a number of vehicles on the same road segment. Thus, the data collected for each of the predetermined routes and their corresponding parameter thresholds are determined, one threshold for each route.

In one embodiment, the ADV 101 can be driven either in a manual mode or in an autonomous driving mode for a number of trips on a particular road segment. During the trips, the ADV 101 may collect CPU usage data points for each CPU on the ADV, and the E2E latency data points of the ADS 110 in the ADV.

In one embodiment, each data point for the E2E latency and the CPU usage may be collected in each driving cycle or each several driving cycles, or only collected for each new driving scenario. A driving scenarios may be defined by one or more of a number of indicators, including a quantity of obstacles, a density of the obstacles, types of the obstacles, and directions of the obstacles. An obstacle may be a static object or a moving object on the road segment.

The data points collected for each of the system load parameters such as the CPU usage and the E2D latency may be plotted into a distribution, from which a threshold for each system load parameter may be determined.

As shown in FIG. 4, in one embodiment, a CPU usage threshold 408 and a E2E latency threshold 409 can be maintained by a redundant ADS 110B, where the thresholds may be determined based on the prior driving data collected from a large number of vehicles. The process of analyzing and determining the thresholds may be performed offline by a data analytics system such as system 103 based on the analysis of the driving data. The redundant ADS 110B can be provided in the ADV 101 to monitor the system load of the ADV and primary ADS 110A to detect any abnormalities. The CPU usage threshold 408 can be an average usage value of all CPUs 401-405 that support the execution of primary ADS 110A. The E2E latency threshold 409 can be a time it takes for primary ADS 110A to process sensor data. In one embodiment, it can be the time from receiving sense data by the perception module 302 to taking an appropriate action by the control module 306 in response to the sensor data.

In one embodiment, the redundant ADS 110B can include a duplicate copy of each AD module in primary ADS 110A as well as one or more software modules to monitor the performance of the primary ADS 110A and the system load of the ADV. The redundant ADS 110B can run on a piece of separate hardware, for example, an industry standard electronic control unit (ECU); and can communicate with the other AD modules via an internet hub, a local network or a message-based bus. In the event that that the primary ADS 110A malfunctions, the control of the ADV would be passed to the redundant ADS 110B.

In one embodiment, when the system load of the ADV 101 as measured by real-time CPU usage and E2E latencies is too heavy, the performance of the primary ADS 110A would be reduced. The heavy system load may be caused by the ADV 101 attempting to navigate through a complex driving scenario, e.g., a large number of pedestrians with a high density that are walking towards different directions.

In one embodiment, the redundant ADS 110B can monitor a number of system load parameters, including a real-time CPU usage 411 and a real-time latency 413 of the primary ADS 110A. When either the real-time CPU usage 411 or the real-time latency 413 reaches its corresponding predetermined threshold, a system warning generator 414 can generate a warning message, which can be sent to a display screen 419 via a CAN bus module 415 for the safety operator to read. Alternatively, the warning message can be translated into a horn alarm to sound a horn 417. The warning message or the horn alarm would remind the safety operator that the ADV 101 has encountered a complex driving scenario that needs the attention of the safety operator.

Therefore, the system load based warning system can relieve the safety operator of the burden of constantly monitoring the outside driving environment for any driving scenarios that would need the safety operator to take over the control of the ADV 101.

Figure 5:
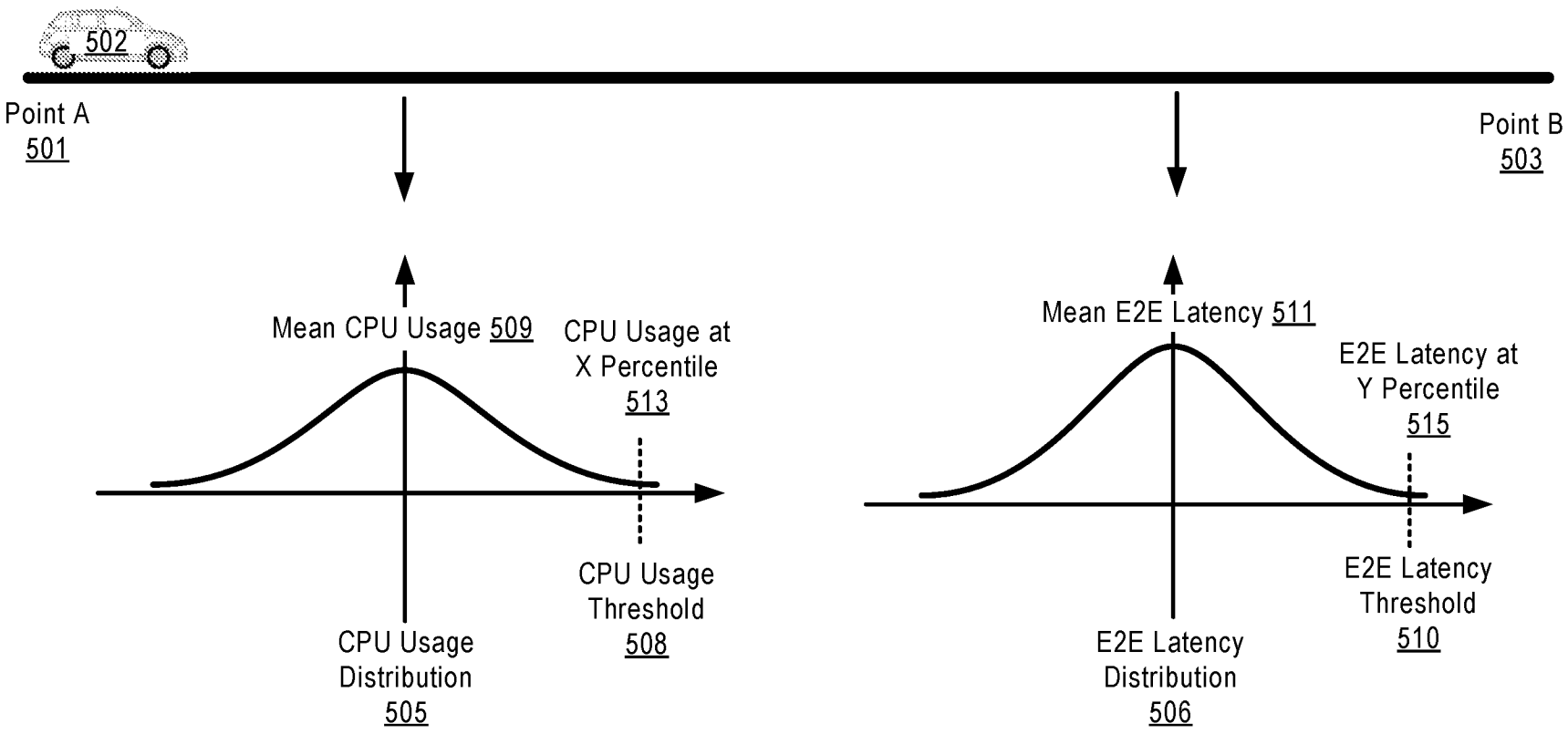
FIG. 5 is diagram illustrating one example of determining system load parameter thresholds according to one embodiment.

FIG. 5 is diagram illustrating one example of determining system load parameter thresholds according to one embodiment. As described above, the system load of an ADV can impact the performance of the ADV, and is directly related to the complexity of a driving scenarios. To drive through a complex driving scenario, the ADV needs more computations as opposed to when the ADV drives through a less complex driving scenario, thereby increasing the system load.

In one embodiment, the system load of an ADV can be measured by the CPU usage of the ADV and the E2E latency of the ADV (e.g., the E2D latency of the primary ADS 110A). To determine whether the system load is too heavy, a threshold value for each system load parameter can be predetermined based on system load data collected by the same ADV from the same road segment that the ADV is to travel on.

In FIG. 5, an ADV 502 can travel on a road segment from point A 501 to point B 503 for one or more trips. In each trip, a redundant ADS (e.g., the redundant ADS 110B in FIG. 4) can collect data periodically (e.g., each driving cycle or every 5 driving cycles). As the ADV 502 travels through driving scenarios of different complexities on the road segment, the system load of the ADV 502 would fluctuate. Data points related to system load collected along the road segment can be plotted into distributions, from which thresholds can be determined.

For example, a CPU usage distribution 505 can be plotted from data points for CPU usages of the ADV 502. The CPU usages can be an average CPU usage of all CPUs supporting the primary ADS 110B. The CPU usage distribution 505 can be a normal distribution with a mean CPU usage 509. The CPU usage threshold 508 can be a value at X percentile 513 on the CPU usage distribution 505. Since the threshold value 508 is to trigger a warning message for the human safety operator to intervene, the threshold can be set at a very high percentile. In one example, the percentile can be set at a 99 percentile. A typical CPU usage can be about 30% with a peak (at the 99 percentile) usage being 50%.

Similarly, an E2E latency distribution 506 with a mean E2E latency 511 can be plotted from data points collected by the ADV 501 while the ADV 510 travels on the road segment from point A 501 to point B 503. The E2E latency threshold 510 can be set at a Y percentile 515 on the E2E latency distribution 506. In one example, the percentile used for determined the E2D latency threshold 510 can be the same percentile as the one used for determining the CPU usage threshold 508 or a different percentile. A typical E2E latency percentile is about 150 ms, with a peak latency (at the 99 percentile) being about 250 ms.

In one embodiment, both the CPU usage threshold 508 and the E2E latency threshold 510 may be specific to the ADV 502, and are applicable only when the ADV 502 travels on the specific road segment from point A 501 to point B 503.

In one embodiment, the redundant ADS of the ADV 502 can contain multiple of sets of system load thresholds, each set for a different road segment, as illustrated in Table 1 below:

TABLE 1

| Road Segment Name | Traffic Complexity | Examples of System Load Thresholds for an ADV |
|---|---|---|
| Road Segment A | Medium | CPU Usage: 97%<br>E2E Latency: 220 ms |
| Road Segment B | Light | CPU Usage: 95%<br>E2E Latency: 200 ms |
| Road Segment N | High | CPU Usage: 99%<br>E2E Latency: 250 ms |

As shown in Table 1, the system load thresholds for the same ADV can be different for different road segments depending on the traffic complexity of each road segment. For example, the CPU usage threshold and the E2E latency threshold for road segment N are higher than those for the other two road segments. Otherwise, the ADV would generate warning messages too frequently.

Figure 6:
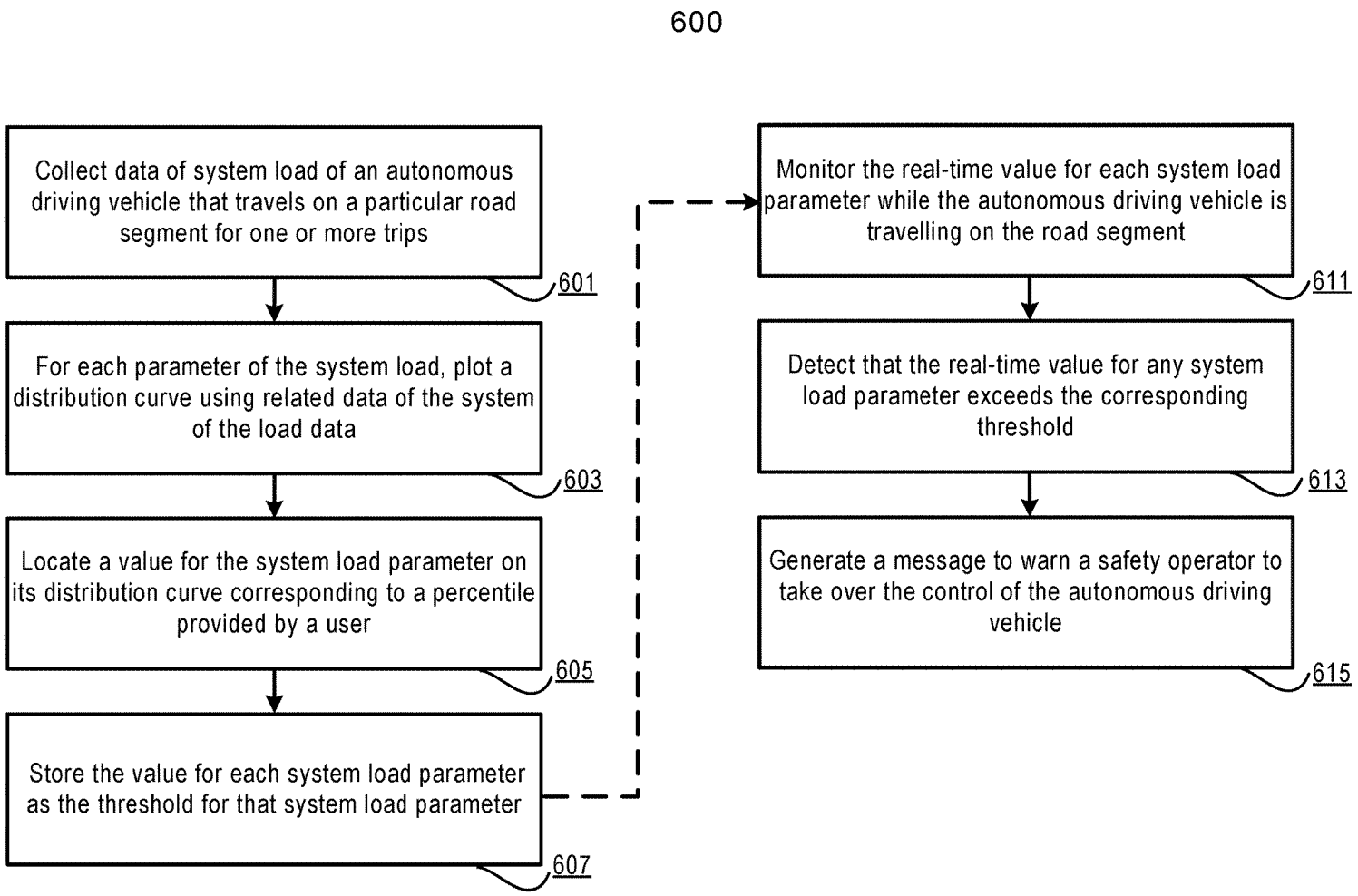
FIG. 6 is a flow diagram illustrating a process of generating a warning message based on the system load of an ADV according to one embodiment.

FIG. 6 is a flow diagram illustrating an example of a process 600 of generating a warning message based on system load according to one embodiment. The process 600 can be divided into an offline portion and an online portion. The offline portion includes operations 601-607, and the online portion includes operations 611-615.

Referring to the operations 601-607 in the offline portion, which are performed to derive a threshold for each of a number of system load parameters, including a CPU usage and an end-to-end (E2E) latency. In operation 601, an autonomous driving vehicle with a redundant ADS installed thereon travels on a particular road segment for one or more trips to collect system load data. The redundant ADS can collect the CPU usage and the E2D latency of the autonomous driving vehicle periodically, for example, in each driving cycle or each three driving cycles.

In operation 603, the redundant ADS plots a separate distribution curve for each system load parameter using the related data points collected in operation 601. One example of a distribution curve is a normal distribution curve. Other types of distribution curves can also be used depending on the collected data. In operation 605, the redundant ADS locates a value corresponding to a given percentile on the distribution curve for each system load parameter. For the distribution curve of CPU usages, a percentile of 95 or 99 can be used. For the distribution curve of E2E latency values, a percentile of 99 can be used. The percentile for each system load parameter may be determined by users. In operation 607, the value corresponding to the given percentile for each system load parameter can be stored as the threshold value for that system load parameter.

Referring to operations 611-615 in the online portion, in operation 611, the redundant ADS monitors the real-time value for each system load parameter while the autonomous driving vehicle is travelling on the particular road segment. In operation 613, the redundant ADS detects that the real-time value for any system load parameter exceeds the corresponding threshold. In operation 615, the redundant ADS generates a message to warn a safety operator to take over the control of the autonomous driving vehicle. Note that the offline portion and the online portion may be performed by different vehicles at different points in time.

Figure 7:
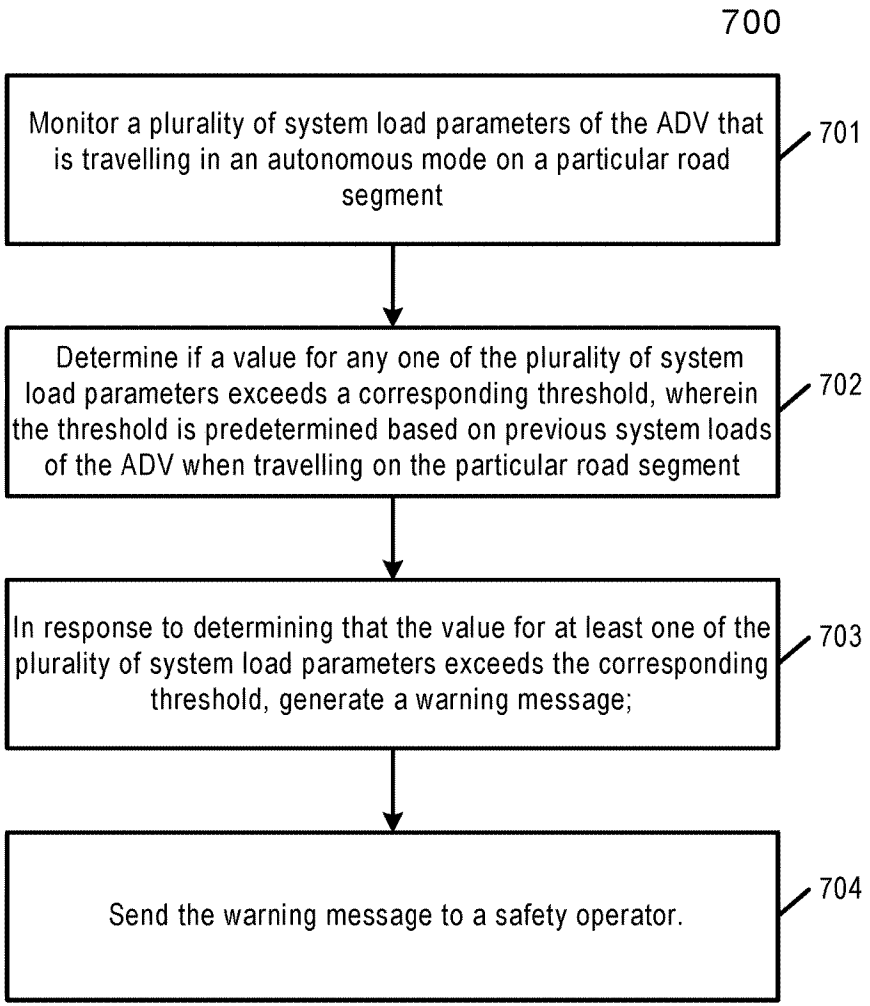
FIG. 7 is a block diagram illustrating a process of generating a warning message based on the system load of an ADV according to one embodiment.

FIG. 7 is a block diagram illustrating a process 700 of generating a warning message based on the system load of an ADV according to one embodiment. Process 700 may be performed by processing logic which may include software, hardware, or a combination thereof. For example, process 700 may be performed by the redundant ADS 110B described in FIG. 4.

Refer ring to FIG. 7, in operation 701, the processing logic monitors a plurality of system load parameters of the ADV that is travelling in an autonomous mode on a particular road segment. In operation 702, the processing logic determines if a value for any one of the plurality of system load parameters exceeds a threshold, wherein the threshold is predetermined based on previous system loads of the ADV when travelling on the particular road segment. In operation 703, the processing logic generates a warning message in response to determining that the value for at least one of the plurality of system load parameters exceeds the corresponding threshold. In operation 704, the processing logic sends the waring message to a safety operator.

Note that some or all of the components as shown and described above may be implemented in software, hardware, or a combination thereof. For example, such components can be implemented as software installed and stored in a persistent storage device, which can be loaded and executed in a memory by a processor (not shown) to carry out the processes or operations described throughout this application. Alternatively, such components can be implemented as executable code programmed or embedded into dedicated hardware such as an integrated circuit (e.g., an application specific IC or ASIC), a digital signal processor (DSP), or a field programmable gate array (FPGA), which can be accessed via a corresponding driver and/or operating system from an application. Furthermore, such components can be implemented as specific hardware logic in a processor or processor core as part of an instruction set accessible by a software component via one or more specific instructions.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Embodiments of the disclosure also relate to an apparatus for performing the operations herein. Such a computer program is stored in a non-transitory computer readable medium. A machine-readable medium includes any mechanism for storing information in a form readable by a machine (e.g., a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices).

The processes or methods depicted in the preceding figures may be performed by processing logic that comprises hardware (e.g. circuitry, dedicated logic, etc.), software (e.g., embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

Embodiments of the present disclosure are not described with reference to any particular programming language. It will be appreciated that a variety of programming languages may be used to implement the teachings of embodiments of the disclosure as described herein.

In the foregoing specification, embodiments of the disclosure have been described with reference to specific exemplary embodiments thereof. It will be evident that various modifications may be made thereto without departing from the broader spirit and scope of the disclosure as set forth in the following claims. The specification and drawings are, accordingly, to be regarded in an illustrative sense rather than a restrictive sense.

What is claimed is:

1. A computer-implemented method of generating a warning message based on system load of an autonomous driving vehicle (ADV), comprising:

monitoring a plurality of system load parameters of the ADV that is travelling in an autonomous mode on a particular road segment, wherein the plurality of system load parameters includes a central processing unit (CPU) usage;

determining whether any one of the system load parameters exceeds a corresponding threshold, wherein each threshold is predetermined based on prior driving data captured and collected from one or more vehicles when travelling on the particular road segment;

in response to determining that at least one of the system load parameters exceeds the corresponding threshold, generating a warning message; and sending the warning message.

2. The method of claim 1, wherein the plurality of system load parameters includes an end-to-end (E2E) latency.

3. The method of claim 1, wherein the CPU usage represents an average of CPU usages of one or more CPUs in the ADV.

4. The method of claim 2, wherein the E2E latency represents a time taken by the ADV from receiving sensor data to taking an appropriate action in response to the sensor data.

5. The method of claim 1, wherein the threshold for each of the plurality of system load parameters is derived from a distribution of that system load parameter when the ADV travels on the particular road segment for one or more trips.

6. The method of 5, wherein values of each of the plurality of system load parameters change with complexity of driving scenarios on the particular road segment.

7. The method of 6, wherein the driving scenarios include one or more of a quantity of obstacles, a density of the obstacles, one or more types of the obstacles, or one or more directions of the obstacles.

8. A non-transitory machine-readable medium having instructions stored therein for generating a warning message based on system load of an autonomous driving vehicle (ADV), which instructions when executed by a processor, cause the processor to perform operations, the operations comprising:

monitoring a plurality of system load parameters of the ADV that is travelling in an autonomous mode on a particular road segment, wherein the plurality of system load parameters includes a central processing unit (CPU) usage;

determining whether any one of the system load parameters exceeds a corresponding threshold, wherein each threshold is predetermined based on prior driving data captured and collected from one or more vehicles when travelling on the particular road segment;

in response to determining that at least one of the system load parameters exceeds the corresponding threshold, generating a warning message; and sending the warning message.

9. The non-transitory machine-readable medium of claim 8, wherein the plurality of system load parameters includes an end-to-end (E2E) latency.

10. The non-transitory machine-readable medium of claim 8, wherein the CPU usage is an average of CPU usages of one or more CPUs in the ADV.

11. The non-transitory machine-readable medium of claim 9, wherein the E2E latency is a time taken by the ADV from receiving sensor data to taking an appropriate action in response to the sensor data.

12. The non-transitory machine-readable medium of claim 8, wherein the threshold for each of the plurality of system load parameters is derived from a distribution of that system load parameter when the ADV travels on the particular road segment for one or more trips.

13. The non-transitory machine-readable medium of claim 12, wherein values of each of the plurality of system load parameters change with complexity of driving scenarios on the particular road segment.

14. The non-transitory machine-readable medium of claim 13, wherein the driving scenarios include one or more of a quantity of obstacles, a density of the obstacles, one or more types of the obstacles, or one or more directions of the obstacles.

15. A data processing system, comprising:

a processor; and a memory coupled to the processor to store instructions therein for generating a warning message based on system load of an autonomous driving vehicle (ADV), which instructions when executed by the processor, cause the processor to perform operations, the operations including:

monitoring a plurality of system load parameters of the ADV that is travelling in an autonomous mode on a particular road segment, wherein the plurality of system load parameters includes a central processing unit (CPU) usage, determining whether any one of the system load parameters exceeds a corresponding threshold, wherein each threshold is predetermined based on prior driving data captured and collected from one or more vehicles when travelling on the particular road segment, in response to determining that at least one of the system load parameters exceeds the corresponding threshold, generating a warning message, and sending the warning message.

16. The system of claim 15, wherein the plurality of system load parameters includes an end-to-end (E2E) latency.

17. The system of claim 15, wherein the CPU usage is an average of CPU usages of one or more CPUs in the ADV.

18. The system of claim 16, wherein the E2E latency represents a time taken by the ADV from receiving sensor data to taking an appropriate action in response to the sensor data.

19. The system of claim 15, wherein the threshold for each of the plurality of system load parameters is derived from a distribution of that system load parameter when the ADV travels on the particular road segment for one or more trips.

20. The system of claim 19, wherein values of each of the plurality of system load parameters change with complexity of driving scenarios on the particular road segment.

* * * * *